US005816200A

United States Patent [19]

Mann et al.

[11] Patent Number: 5,816,200

[45] Date of Patent: Oct. 6, 1998

[54] WINDBOX WITH INTEGRAL TRUSS SUPPORT AND AIR ADMISSION, FUEL ADMISSION AND IGNITOR MODULES

[75] Inventors: Jeffrey S. Mann, Broad Brook; Michael S. McCartney, Bloomfield, both of Conn.

[73] Assignee: Combustion Engineering, Inc., Windsor, Conn.

[21] Appl. No.: 773,463

[22] Filed: Dec. 23, 1996

[51] Int. Cl.[6] ..... F22B 37/00

[52] U.S. Cl. ..... 122/494; 110/273

[58] Field of Search ..... 122/493, 494, 122/468, DIG. 11; 431/9, 154, 173, 174; 110/234, 260–265, 297, 336, 273

[56] References Cited

U.S. PATENT DOCUMENTS

| | | | |
|---|---|---|---|
| 2,654,352 | 10/1953 | Schoenfeld | 122/494 |
| 3,364,905 | 1/1968 | Jordan | 122/494 |
| 3,479,994 | 11/1969 | Kreider et al. | 122/494 |
| 3,530,835 | 9/1970 | Wiesenthal | 122/494 X |
| 3,608,525 | 9/1971 | Sharan | 122/494 X |
| 3,971,345 | 7/1976 | Csathy | 122/494 X |
| 4,008,691 | 2/1977 | Kreider et al. | 122/494 |
| 4,294,178 | 10/1981 | Borio et al. | 431/173 X |
| 5,339,891 | 8/1994 | Kidaloski et al. | 122/494 X |
| 5,441,000 | 8/1995 | Vatsky et al. | 431/174 X |
| 5,593,298 | 1/1997 | Hurley et al. | 431/9 |

*Primary Examiner*—Christopher Kilner
*Attorney, Agent, or Firm*—Robert S. Smith

[57] ABSTRACT

A steam generator apparatus which includes an enclosure comprising vertically extending front and back waterwalls joined by opposed spaced first and second waterwalls, The enclosure also includes a plurality of spaced vertically extending windboxes, each of the windboxes faces the interior of the enclosure. Each of the windboxes comprises a plurality of modules that are configured for installation at respective elevations, each of the modules being dimensioned and configured for shipment to the installation site. Some forms of the invention further includes a vertically extending truss assembly and the ignitor and auxiliary air compartments are supported on the truss assembly. Other forms of the invention include air ducting supplying air to air compartments and the truss assembly extends within the ducting. Still other forms of the invention may utilize the truss assembly without the modular windbox.

6 Claims, 4 Drawing Sheets

WINDBOX WITH INTEGRAL TRUSS SUPPORT AND AIR ADMISSION, FUEL ADMISSION AND IGNITOR MODULES

TECHNICAL FIELD

The invention relates to the field of steam generation apparatus and particularly relates to the construction of the windboxes assemblies including the associated air admission, fuel admission and ignitor assemblies in such apparatus. The typical tangentially fired furnace as viewed in a plan view has a generally square arrangement of water walls each made up of a plurality of vertical tubes. The tubes in the respective water walls are disposed in generally parallel relationship. Disposed at the four corners of the typical furnace are the windboxes that direct combustion air into the furnace. While the invention has particular application to tangentially fired furnaces and the description of the preferred embodiment will described in terms of a tangentially fired furnace, it will be understood that the invention also has application to furnaces having other firing systems. Similarly, although the invention will be described in terms of a coal fired system, those skilled in the art will recognize that other fuels including (1) gases such as natural gas, refinery gas, coke oven gas and hydrogen; (2) liquids such as oil, tars, pitch black liquor; and (3) other solids such as biomass and refuse may also be utilized in the apparatus of the present invention.

The field construction of a boiler includes erection of the windbox assembly after intermediate waterwall panels are in place. The rigging of a furnace windbox assembly is one of the most difficult tasks in the construction of a boiler. The difficulty arises because of the weight, shape, and balance points of the parts of the assembly. When the windbox comes from the shop to the erection site, sections of waterwall tubing are attached to it. These are welded into the already erected wall panels and help support the windbox. Additional hangar rods support the back side of the assembly. The weight of the windbox assembly is typically about 25 to 30 tons. The immense size and weight of windboxes for coal fired steam generator boilers and the customary dependence of the windbox for support by the waterwall and spring hangers extending from the top of the steam generator boiler complicate the construction of the windbox assembly as well as attempts to modularize the construction.

Tangential firing is one method of firing coal in conventional coal fired steam generator boilers. In the systems fired by pulverized coal the pulverized coal enters the furnace in a primary air stream through the fuel air admission assemblies. A conventional wind box assembly comprises a vertical array of alternate secondary air compartments and fuel air admission assemblies. The fuel air stream discharged from these fuel air admission assemblies is directed tangentially to an imaginary circle in the middle of the furnace. This creates a fireball that serves as a continuous source of ignition for the incoming coal. More specifically, a flame is established at one corner which in turns supplies ignition energy to stabilize the flame emanating from a corner downstream of and laterally adjacent.

Replacement of the windbox assembly including air admission, fuel admission and ignitor elements on existing steam generator boilers often requires temporary alteration of the power plant structure merely to allow movement of the components. The replacement of this apparatus is necessary in various situations such as after a fire or to repair equipment that has deteriorated over a long time period or deteriorated as the result of excess pipe loading.

OBJECTS AND SUMMARY OF THE INVENTION

It is an object of the present invention to provide air admission, fuel admission and ignitor modules that are each approximately three tons or less in weight. Another object of the invention is to provide apparatus that will be substantially free standing and substantially supported independently of the waterwalls and spring hangers.

It is an object of the invention to provide a such modules that are small enough to be moved through a fossil fueled power plant without the necessity to make temporary changes to the power plant structure.

Still another object of the invention is to provide a freestanding windbox construction that may be installed as part of a new power plant or retrofitted to an existing power plant.

It has now been found that these and other objects of the invention may be attained in a steam generator apparatus which includes an enclosure comprising vertically extending front and back waterwalls joined by opposed spaced first and second waterwalls, The enclosure also includes a plurality of spaced vertically extending windboxes, each of the windboxes faces the interior of the enclosure. Each of the windboxes comprises a plurality of modules that are configured for installation at respective elevations, each of the modules being dimensioned and configured for shipment to the installation site.

In some forms of the invention at least one of the modules in each of the windboxes is a coal and ignition module comprising an ignitor and auxiliary air compartment and a first coal compartment disposed at a higher elevation than the ignitor and auxiliary air compartment and a second coal compartment disposed at a lower elevation than the ignitor and auxiliary air compartment. Some embodiments have at least one modules that is an air module. The air module may include a first air compartment at a first elevation and a second air compartment at higher elevation. Some forms of the invention may have at least one air compartment disposed vertically adjacent to each coal compartment. Some embodiments may include an ignitor and auxiliary air compartment that includes a central conduit for a liquid fuel. Each of the coal compartments may have a coal nozzle inlet section and a coal nozzle outlet section, and the ignitor and auxiliary air compartment includes a thick walled ignitor box. The coal compartment inlet and outlet sections may be coupled by a coupling which is constructed to provide both coupling and an intermediate gap to limit transfer of forces due to coal pipe loading.

Some forms of the invention further includes a vertically extending truss assembly and the ignitor and auxiliary air compartments are supported on the truss assembly. Other forms of the invention include air ducting supplying air to the air compartments and the truss assembly extends within the ducting.

Still other forms of the invention may have an enclosure comprising vertically extending front and back waterwalls joined by opposed spaced, first and second waterwalls; the enclosure also including a plurality of spaced vertically extending windboxes, the windboxes including air compartments and air ducting supplying air to the air compartments and the truss assembly extends within the ducting. Each of the windboxes may face the interior of the enclosure, each of the windboxes may comprise a plurality of modules configured for installation at respective elevations, each of the modules being dimensioned and configured for shipment to the installation site.

BRIEF DESCRIPTION OF THE DRAWING

The invention will be better understood by reference to the accompanying drawing in which.

DESCRIPTION OF THE PREFERRED EMBODIMENT

Figure 1:
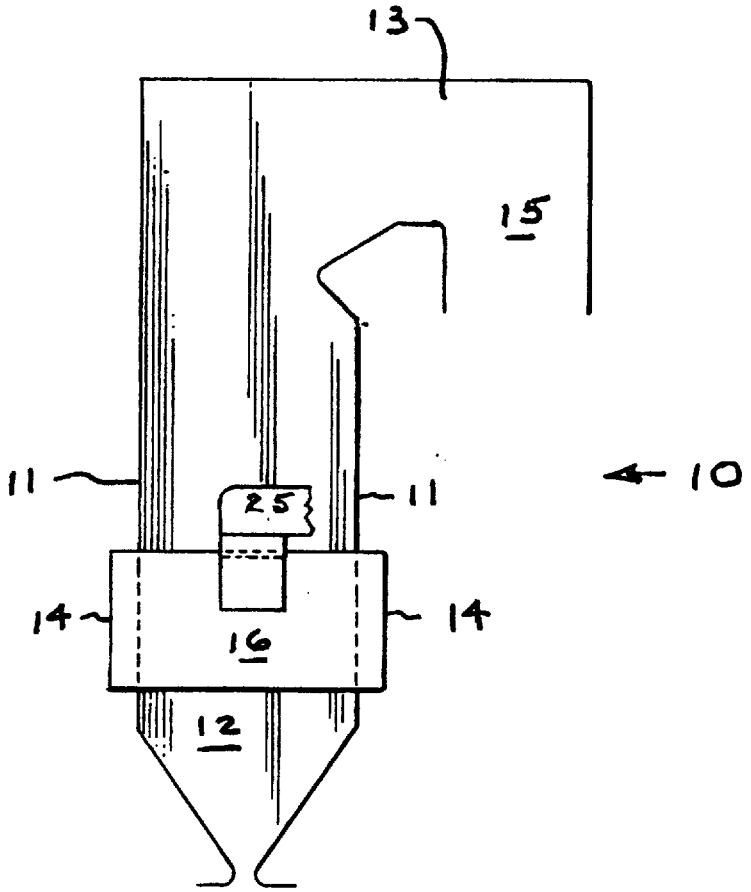
FIG. 1 is a partially schematic elevational view of a coal fired steam generator boiler incorporating the present invention.

Referring now to the drawing there is shown the preferred embodiment of the present invention. Various other embodiments may be constructed without departing from the spirit of the invention. As best seen in FIG. 1 a conventional furnace 10 has a central cavity 12 surrounded by a front wall, a rear wall and two opposed side walls. The side walls (not shown) are disposed in spaced relationship and join the front wall and the rear wall. Each of these walls is a waterwall 11 comprising a plurality of substantially parallel, substantially coplanar tubular members.

The furnace 10 is vertically disposed and has an outlet for combustion gases at its upper end extending from the rear wall thereof. Extending from this outlet is a lateral gas pass 13 which connects with the upper end of a vertically extending gas pass 15 that extends downwardly in parallel relation with the cavity 12. Combustion gases sequentially pass through the cavity 12, the lateral gas pass 13, the vertically extending gas pass 15 and a stack (not shown). It will be understood the present invention may be incorporated in a wide variety of furnace structures and that the illustrated furnace 10 is only one such furnace.

The furnace 10 includes windbox assemblies 14 at each of the four corners of the central cavity 12. Adjacent windbox assemblies are coupled by a plenum 16. Thus, the entire furnace includes four such plenums 16 coupling adjacent windbox assemblies 14. Each such plenum is coupled by a duct 25 which is coupled to a fan (not shown) which supplies air for the combustion process in the cavity 12.

An object of the invention is to provide modules that weigh three tons or less and which have an envelope small enough to allow passage of individual modules through a fossil fuel power plant structure without having to make temporary changes to the power plant structure. For example, the size of individual modules must not require changes in the furnace and building openings. The arrangement of components within individual modules as well as the relative positions of different modules requires arrangements of particular components that differs from the usual and customary arrangement to achieve the noted object. One technique to achieve the stated object is the elimination of auxiliary air that would customarily be fed along the sides of the coal nozzle. Instead auxiliary air is fed either from above or below each coal nozzle.

Referring now to FIGS. 2–6 there is shown, in partially schematic form, the construction of one of the windbox assemblies 14. Each such windbox assembly includes five modules in the illustrated embodiment. The five modules are: first and second air modules 18, 20; first and second ignition and coal compartment modules 22, 24 and an air compartment 21.

The first and second air modules 18, 20 are identical. Each of the air modules 18, 20 includes two air compartments 21, 21 that are substantially identical. In each of the air modules 18, 20 the air compartments 21, 21 are separated by a removable division plate 23 that is constructed to permit removal from the nonfurnace side of the compartment.

The first and second ignition and coal compartment modules 22, 24 are identical. Each of these modules 22, 24 includes first and second coal compartments 26. 26 and an ignitor and an auxiliary air compartment 28. Each ignitor and auxiliary air compartment 28 includes a central conduit 30 for oil or gas. In the conventional manner the oil or gas is fed through the conduit 30 during start up of the boiler. As in the conventional tangential fired boiler a fireball is produced in the cavity 12. The conduit 30 is concentric with a pipe 32 for auxiliary air. Tilting nozzles 36 face the cavity 12 to direct auxiliary air into the cavity 12.

Disposed at the very bottom of the windbox assembly 14 is the fifth module that is referred to herein as a third air module 25. That third air module 25 is merely a single air compartment 21. (Although there may be minor differences between the air compartment 21 in the third air module 25 and the air compartments 21 in the first and second air modules 18, 20, the difference is not material to describing the invention so that one skilled in the art can understand the invention.)

It will be seen that each coal nozzle 36 is in between at least one air compartment 21 and one pipe 32 supplying auxiliary air. Although the illustrated embodiment is a preferred embodiment of the invention, those skilled in the art will recognize that various other modular forms and numbers of various module types may be utilized in other embodiments of the invention.

As best seen in FIGS. 3–6 the windbox assembly 14 includes a vertically elongated truss assembly 44. The truss assembly 44 has a triangular cross-section as will be apparent from FIGS. 3–5. Those skilled in the art will recognize that the truss assembly 44 is a rigid framework capable of supporting a substantial load. In the apparatus in accordance with a preferred form of the invention the truss assembly 44 provides substantially all of the support for the windbox assembly 14. A small part of the total support for the windbox assembly 14 is provided by the waterwall 11. The preferred form of the invention does not rely on spring hangers (not shown) extending from the very top of the boiler structure to support the waterwall 11. The truss assembly 44 is particularly advantageous for support of the windbox assembly 14 because the support inherently must extend through the windbox assembly 14. The truss assembly 44 is preferably dimensioned to be disposed close to the walls of the windbox assembly 14 that the truss assembly 44 supports. The relatively small size of the members in the truss assembly 44 minimizes the restriction of fluid flow in the windbox assembly 14.

The truss assembly 44 directly supports the duct work of the windbox assembly 14. In the conventional manner each plenum 16 is coupled to two windbox assemblies 14 as shown in FIG. 1. The body 48 of the windbox assembly 14 acts as a plenum to direct air entering from the duct 25 and passing through the plenum 16 to (1) the first and second air modules 18, 20; (2) respective pipes 32 in the auxiliary air compartments 28 in the ignitor and auxiliary air compartments 22, 24 and (3) the third air module 21.

Figure 6:
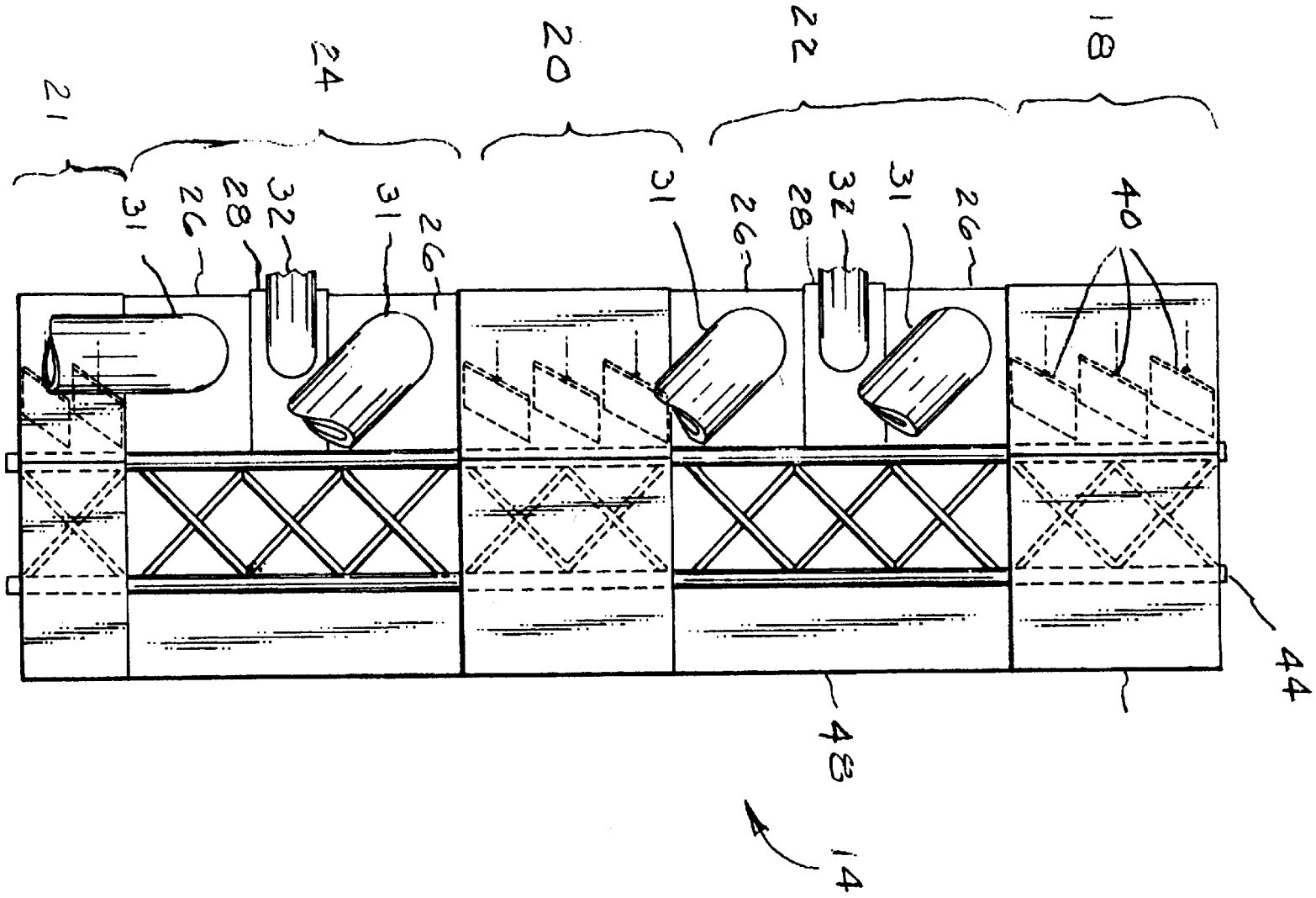
FIG. 6 is a back elevational view of the apparatus shown in FIG. 2. The term "back elevational view" in this context refers to a view in a direction that is coincident with a line extending diagonally through a plan view of the furnace enclosure in a direction that faces the diagonally opposite corner of the central furnace cavity.

As best seen in FIG. 6 the coal compartments 26 are each connected to respective coal pipes 31. Each of the coal compartments 26 has a coal nozzle inlet and a coal nozzle outlet section mounted on a thick walled ignitor box of the ignitor and auxiliary air modules. The inlet and outlet portions are coupled by a coupling 37 which is constructed to provide both coupling and an intermediate gap to limit transfer of forces due to coal pipe loading. Similarly, the ignitor and auxiliary air modules 22 are each connected to an air pipe 32. The support provided by the truss assembly 44 to the housing of the windbox assembly 14 inherently is a support for the air modules 18, 20, the first and second ignitor and auxiliary air compartments 28 and the first and second ignition and coal compartment modules 22, 24.

Figure 2:
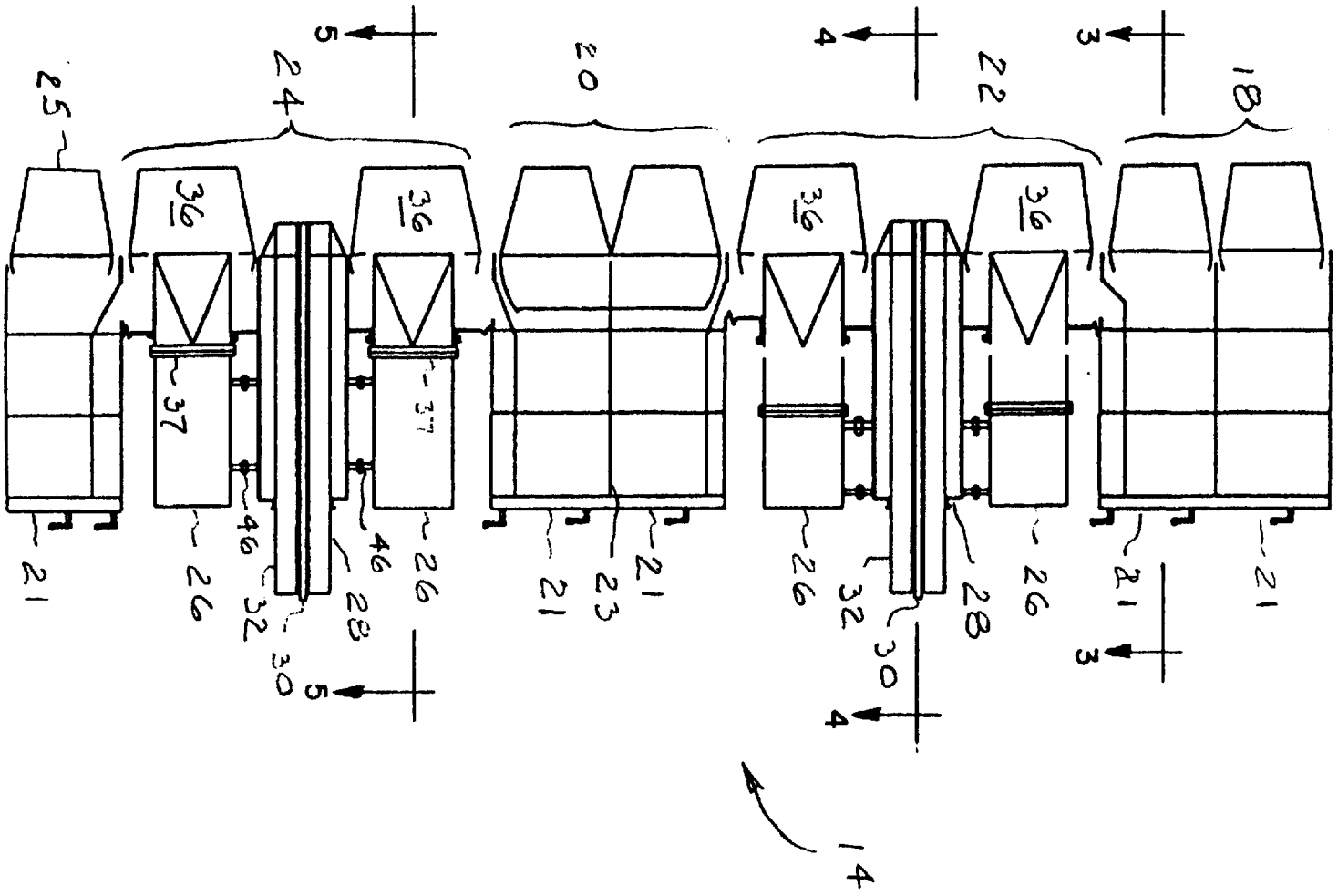
FIG. 2 is a more detailed partially schematic side elevational view of the windbox assembly in accordance with one form of the which is disposed at each of the four corners defined by the intersections of the opposed front and back waterwalls intersecting with the opposed side waterwalls that surround the furnace cavity.
Figure 4:
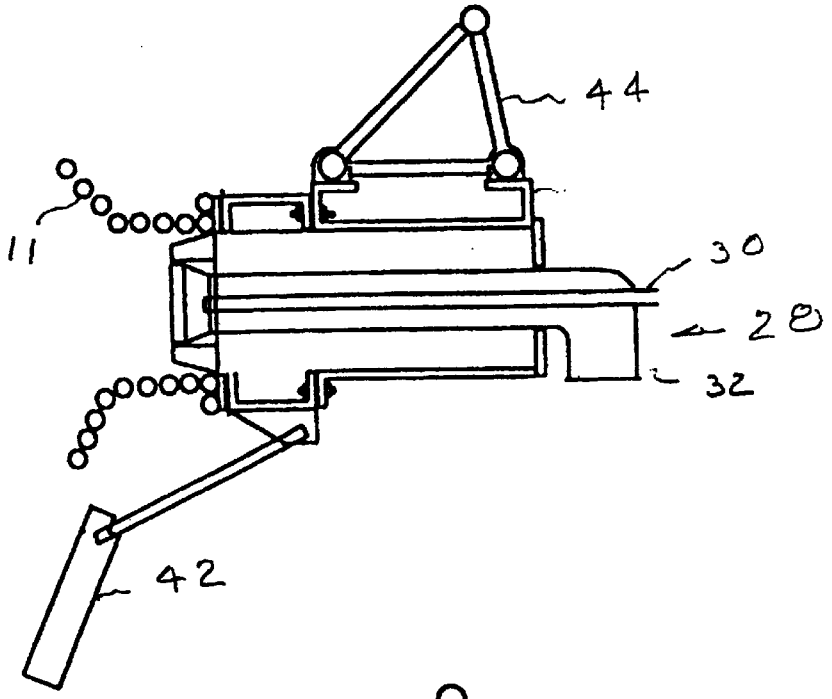
FIG. 4 is a sectional view taken along the line 4—4 of FIG. 2 which illustrates the ignitor module in greater detail.
Figure 5:
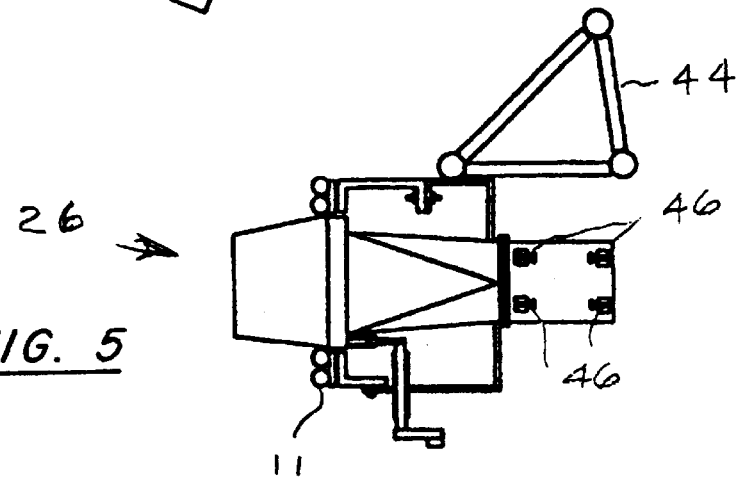
FIG. 5 is a sectional view taken along the line 5—5 of FIG. 2 which illustrates the fuel admission modules in greater detail.

More specifically, a flange 34 on each ignitor and auxiliary air compartment 28 is carried on the truss 44 as best seen in FIG. 4. As best seen in FIGS. 2 and 5 each ignitor and auxiliary air compartment 28 includes four legs 46 extending upwardly and four legs 46 extending downwardly. The four legs 46 extending upwardly are connected to a coal compartment 26 as are the legs 46 that extend downwardly. Thus, the truss assembly 44 also supports each ignitor and auxiliary air compartment 28. Each of these compartments 28 supports two coal compartments 26, 26. In the preferred embodiment the support for the ignitor and auxiliary air compartment 28 is almost completely provided by the truss assembly 44. There is however some slight support provided by a connection 42 between the ignitor module 20 and the waterwall 11.

Figure 3:
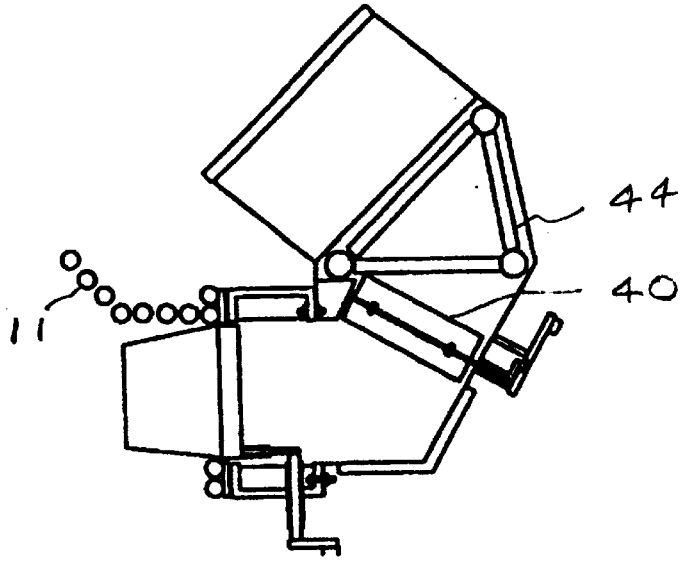
FIG. 3 is a sectional view taken along the line 3—3 of FIG. 2 which illustrates the air admission module in greater detail.

Referring specifically to FIG. 3 and 6 it will be further seen that the truss assembly 46 passes directly through the portion of the windbox 14 that directs air to the air modules 18, 20. Accordingly the truss supports the air modules 18, 20. In a typical embodiment dampers 40 are provided within the windbox assembly 14 to allow modulation of the flow through the air modules 18, 20. The location is closer to the cavity 12 than in conventional apparatus.

Although the invention has been described in terms of a truss to support the windbox and other elements of the apparatus, it will be understood that other support structure may be provided without departing from the invention.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described our invention, we claim:

1. A steam generator apparatus which comprises:

an assembly that includes an enclosure comprising vertically extending front and back waterwalls joined by opposed spaced first and second waterwalls; said assembly also including within said enclosure also including a plurality of spaced vertically extending windboxes, each of said windboxes facing the interior of said enclosure, each of said windboxes comprising a plurality of modules configured for installation at respective elevations, each of said modules being dimensioned and configured for shipment to the installation site, at least one of said modules in each of said windboxes is a coal and ignition module comprising an ignitor and auxiliary air compartment and a first coal compartment disposed at a higher elevation than said ignitor and auxiliary air compartment and a second coal compartment disposed at a lower elevation than said ignitor and auxiliary air compartment, each windbox including a plurality of air modules, each of said plurality of air modules being disposed vertically adjacent to one of said coal compartments.

2. The apparatus as described in claim 1 wherein:

each ignitor and auxiliary air compartment includes a central conduit for a liquid fuel.

3. The apparatus as described in claim 2 wherein:

each of said coal compartments has a coal nozzle inlet section and a coal nozzle outlet section.

4. The apparatus as described in claim 3 wherein:

said ignitor and auxiliary air compartment includes an ignitor box, said coal compartment inlet and outlet sections are coupled by a coupling which is constructed to provide both coupling and an intermediate gap to limit transfer of forces.

5. The apparatus as described in claim 4 wherein:

said apparatus further includes a vertically extending truss assembly and said ignitor and auxiliary air compartments are supported on said truss assembly.

6. The apparatus as described in claim 5, wherein:

said apparatus includes air ducting supplying air to said air compartments and said truss assembly extends within said ducting.

* * * * *